US007101151B2

(12) United States Patent
Loringer et al.

(10) Patent No.: US 7,101,151 B2
(45) Date of Patent: Sep. 5, 2006

(54) DIFFUSER FOR CENTRIFUGAL COMPRESSOR

(75) Inventors: Daniel Edward Loringer, Erie, PA (US); Eric Richard Dillen, Erie, PA (US); Anthony Holmes Furman, Scotia, NY (US); Kendall Roger Swenson, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/887,717

(22) Filed: Jul. 9, 2004

(65) Prior Publication Data

US 2005/0111974 A1 May 26, 2005

Related U.S. Application Data

(60) Provisional application No. 60/505,885, filed on Sep. 24, 2003.

(51) Int. Cl.
*F01D 9/00* (2006.01)

(52) U.S. Cl. ..... 415/211.2

(58) Field of Classification Search ..... 415/211.2; 416/231 R

See application file for complete search history.

(56) References Cited

U.S. PATENT DOCUMENTS 3,644,055 A * 2/1972 Davis ..... 415/208.3
3,930,746 A 1/1976 Kronogard
3,936,223 A 2/1976 Baghdadi
4,012,166 A 3/1977 Kaesser et al.
4,027,997 A 6/1977 Bryans
4,100,732 A 7/1978 Bryans et al.
4,302,150 A 11/1981 Wieland
4,338,063 A 7/1982 Nakanishi
4,349,314 A 9/1982 Erwin
4,431,374 A 2/1984 Benstein et al.
4,538,410 A 9/1985 Klaebo
4,549,847 A 10/1985 Stroem et al.
4,573,868 A 3/1986 Stroem et al.
4,576,550 A 3/1986 Bryans
4,579,509 A 4/1986 Jacobi
4,611,969 A 9/1986 Zinsmeyer
4,629,403 A 12/1986 Wood
4,642,026 A 2/1987 Ruff
4,737,071 A 4/1988 Horn, Jr.
4,740,138 A 4/1988 Zaehring et al.
4,770,605 A 9/1988 Nakatomi
4,815,935 A 3/1989 Gottemoller
4,844,690 A 7/1989 DeLaurier et al.
4,854,126 A 8/1989 Chevis et al.
4,859,145 A 8/1989 Sidransky
4,877,370 A 10/1989 Nakagawa et al.

(Continued)

FOREIGN PATENT DOCUMENTS

DE 195 48 852 A1 12/1995

(Continued)

*Primary Examiner*—Ninh H. Nguyen
(74) *Attorney, Agent, or Firm*—Carlos Hanze; Beusse Wolter Sanks Mora & Maire, P.A.; David G. Maire

(57) ABSTRACT

A diffuser (30) for a centrifugal compressor (60) having a flow slot (34) formed between the leading edge portion (36) of a diffuser vane (32) and an adjoining diffuser wall (70) for the passage of working fluid (67) over the vane from the pressure side ((40) to the suction side (42) of the vane. The portion (38) of the working fluid passing over the vane is injected into the flow boundary region (43), thereby minimizing the growth of a flow separation zone (58) along the suction side.

18 Claims, 5 Drawing Sheets

U.S. PATENT DOCUMENTS

| | | | | |
|---|---|---|---|---|
| 4,900,225 | A | | 2/1990 | Wulf et al. |
| 4,969,798 | A | | 11/1990 | Sakai et al. |
| 5,143,514 | A | | 9/1992 | Adachi |
| 5,178,516 | A | * | 1/1993 | Nakagawa et al. ..... 415/208.3 |
| 5,266,002 | A | | 11/1993 | Brasz |
| 5,310,309 | A | * | 5/1994 | Terasaki et al. ..... 415/208.3 |
| 5,342,183 | A | | 8/1994 | Rafalovich et al. |
| 5,387,081 | A | | 2/1995 | LeBlanc |
| 5,445,496 | A | | 8/1995 | Brasz |
| 5,516,263 | A | | 5/1996 | Nishida et al. |
| 5,529,457 | A | | 6/1996 | Terasaki et al. |
| 5,709,531 | A | | 1/1998 | Nishida et al. |
| 5,807,071 | A | | 9/1998 | Brasz et al. |
| 5,845,482 | A | | 12/1998 | Carscallen |
| 6,129,511 | A | | 10/2000 | Salvage et al. |
| 6,155,777 | A | | 12/2000 | Aschenbruck et al. |
| 6,200,094 | B1 | | 3/2001 | Skoch et al. |
| 6,203,275 | B1 | | 3/2001 | Kobayashi et al. |
| 6,210,104 | B1 | | 4/2001 | Schonenborn |
| 6,220,234 | B1 | | 4/2001 | Baker et al. |
| 6,382,912 | B1 | | 5/2002 | Lee et al. |
| 6,540,481 | B1 | | 4/2003 | Moussa et al. |
| 6,547,520 | B1 | | 4/2003 | Zinsmeyer et al. |
| 6,554,569 | B1 | | 4/2003 | Decker et al. |

FOREIGN PATENT DOCUMENTS

| | | |
|---|---|---|
| EP | 0 305 879 A2 | 6/1988 |
| EP | 0 538 753 A1 | 10/1992 |

* cited by examiner

DIFFUSER FOR CENTRIFUGAL COMPRESSOR

RELATED APPLICATION

This application claims benefit of the 24 Sep. 2003 filing date of U.S. Provisional Application No. 60/505,885.

FIELD OF THE INVENTION

This invention relates generally to the field of turbo machines and more particularly to a diffuser for a centrifugal compressor.

BACKGROUND OF THE INVENTION

Centrifugal compressors are known to utilize diffusers for converting a portion of the kinetic energy of a working fluid leaving a compressor wheel into static pressure by slowing the flow velocity of the working fluid through an expanding flow volume region. Diffusers may incorporate airfoils, commonly called vanes, for directing the working fluid through the expanding volume to enhance this process, with each vane having a pressure side and a suction side relative to an angle of attack of the incoming working fluid. FIG. 1 illustrates how a prior art diffuser 10 may develop a large flow separation zone 12 on the suction side 14 of a diffuser vane 16 under certain conditions. The flow separation zone 12 is essentially a flow boundary layer that has a lower velocity than the remainder of the flow and therefore hinders the overall fluid flow rate. The flow separation zone 12 creates a distorted exit flow 18 from the compressor, reducing the efficiency of the compressor and potentially leading to surge and stall of the compressor, with resultant damage to the compressor and/or a downstream turbocharged engine. For the embodiment of a compressor used as a turbocharger for the diesel engine of a railroad locomotive, the compressor is most vulnerable to such surge and stall events when the locomotive is operating at high altitude, low ambient temperature, and high manifold air temperature; for example when just exiting a high altitude tunnel.

As illustrated in FIG. 1, the conventional wisdom for the design of compressor diffuser vanes 16 is to provide uninterrupted surfaces 20 from the leading edge 22 to the trailing edge 24 of the vanes to maximize the surface area of the vane exposed to the differential pressure between the suction side 14 and the pressure side 26. The position and angle of the vane is chosen as a compromise between avoiding stalling of the flow and maintaining efficient pressure recovery for the angles of attack of the various incoming air flow streams that were anticipated to impinge upon the vane.

DETAILED DESCRIPTION OF THE INVENTION

Through experimentation, the applicants have found that in the prior art centrifugal compressor designs for maximizing diffuser performance, efficiency can be reduced and the vane made more likely to stall, leading to compressor surge due to the formation of a flow separation zone at the suction side of the vane. Furthermore, and as explained in detail hereinafter, the applicants have found that by forming a flow opening allowing a portion of the working fluid to flow through or over the vane from the pressure side to the suction side of the vane, the flow separation zone can be reduced or eliminated, efficiency increased, and the likelihood of stall or surge reduced.

Figure 1:
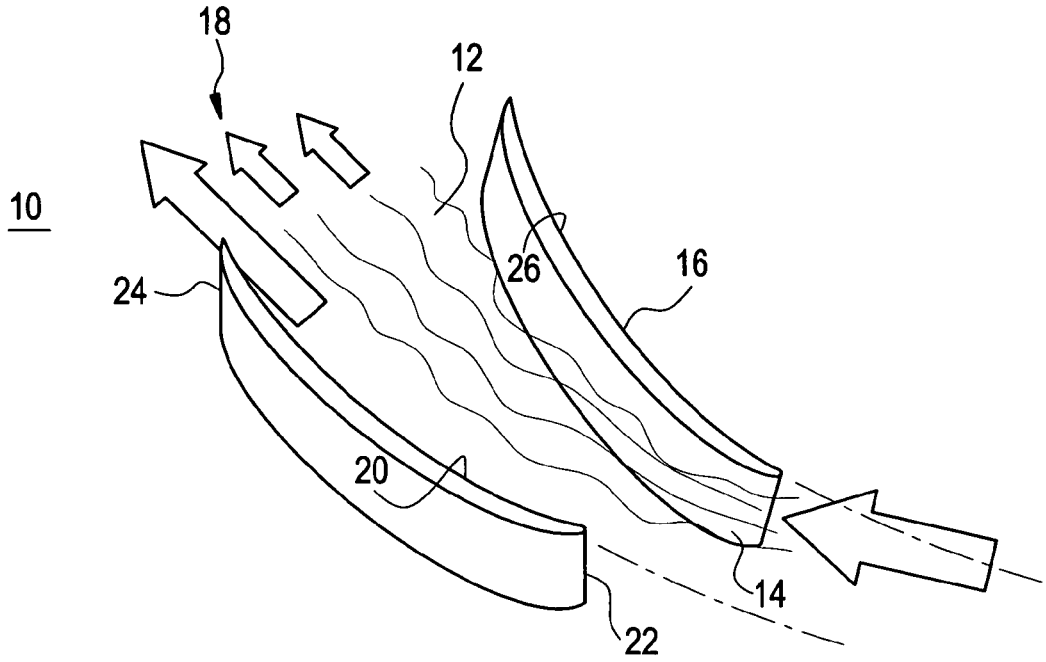
FIG. 1 PRIOR ART
FIG. 1 is an illustration of flow boundary separation from the suction side of a diffuser vane in a prior art centrifugal compressor.
Figure 2:
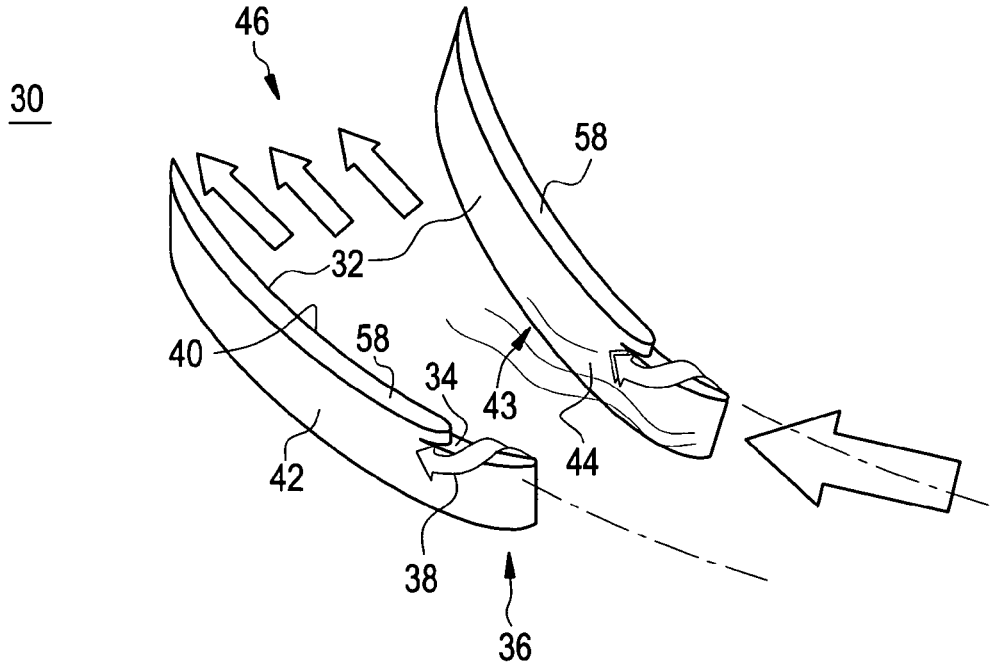
FIG. 2 is an illustration of the flow conditions on the suction side of a slotted diffuser vane.

An improved diffuser 30 for a centrifugal compressor is illustrated in FIG. 2. The diffuser vanes 32 each include an opening allowing a portion 38 of the working fluid to pass from the pressure side 40 to the suction side 42 of the airfoil. The opening is illustrated in FIG. 2 as slot 34 formed between a leading edge portion 36 of the vane 32 and the mating diffuser wall member. The mating wall member is not illustrated in FIGS. 1 and 2 so that the airfoils and working fluid flow paths may be more clearly seen; however, one will appreciate that opposed wall members of the diffuser are positioned above and below and extending between the vanes to define a flow path for the working fluid there between. The slot 34 allows a portion 38 of the working fluid to pass over the vane 32 from the pressure side 40 to the suction side 42, thereby re-energizing the flow boundary region 43 of the working fluid flowing against the suction side 42, and thereby minimizing any flow separation zone 44 that may tend to form. It is believed that the portion 38 of the working fluid passing over the vane 32 creates a vortex that interferes with the growth of the flow separation zone. A comparison of FIG. 1 and FIG. 2 schematically illustrates the reduced size of flow separation zone 44 and the improved uniformity of exit flow 46 of vane 32 compared to prior art vane 16 under the same inlet angle of attack and flow conditions.

Figure 3:
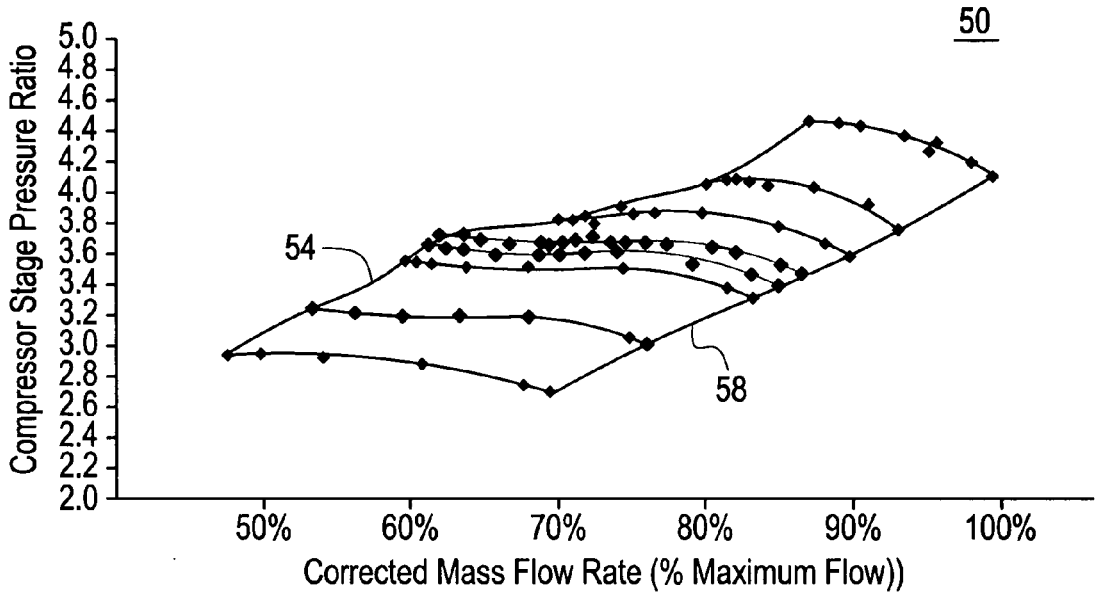
FIG. 3 PRIOR ART
FIG. 3 is a compressor map for a prior art cascade diffuser.
Figure 4:
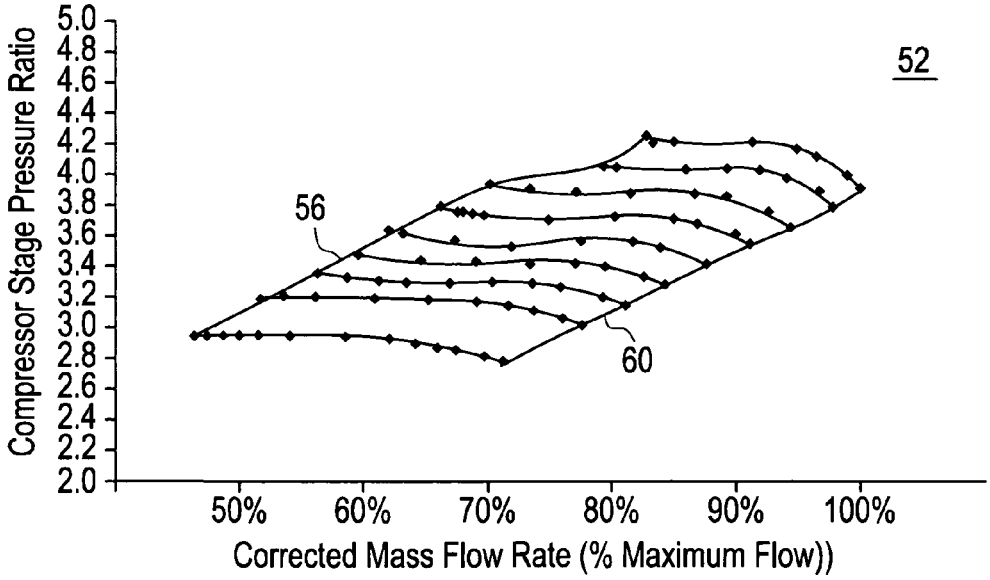
FIG. 4 is a compressor map for a cascade diffuser having slotted vanes.

A comparison of FIGS. 3 and 4 provides a graphical illustration of the improved compressor performance that may be achieved with the slotted diffuser vane 32 of FIG. 2. FIGS. 3 and 4 are traditional compressor maps, and each figure includes a plurality of generally horizontal lines that represent the compressor's performance (temperature corrected flow rate verses compressor stage pressure ratio) at a respective temperature corrected compressor operating speed. FIG. 3 is a performance map 50 for a compressor utilizing a prior art cascade diffuser having vanes of the type shown in FIG. 1. FIG. 4 is an equivalent map 52 for the same compressor having been modified to include flow slots 34 similar to those illustrated in FIG. 2. Notice the extended range of flow rates that are available at any given compressor operating speed (i.e. the longer horizontal portion of the curves extending to both relatively lower and higher flow rates) for the compressor of FIG. 4. Surge lines 54, 56 are constructed by connecting the left end (low flow) points of the various corrected speed lines. In general, under the same conditions, the compressor of FIG. 4 can be operated to a lower flow rate before a stall event will occur. Also notice that the right sides of the various performance lines of the improved design of FIG. 4 generally do not drop downward as quickly as those of the performance lines of FIG. 3. Lines 58, 60 (choke flow) are constructed by connecting the right end (high flow) points of the various corrected speed lines. This difference is an indication of an improved high flow rate efficiency of the compressor of FIG. 4 when compared to the compressor of prior art FIG. 3. The improved performance resulting from the use of flow openings 34 may provide improved margin against surge/stall events, or it may be utilized by the component designer in other ways to improve the overall performance of the component design.

Flow opening slots 34 are gaps formed between the respective vane 32 and the mating diffuser wall (not shown in FIG. 2) when the diffuser 30 is assembled. The vanes 32 are typically formed to be integral with a base plate, such as by machining these components from a single piece of material or by welding separately formed vanes to a base plate. A notch or groove may be machined into a top surface of each vane to extend between the pressure side 40 and the suction side 42 prior to that surface being connected to a respective mating wall. The notches represent material removed to define the flow slots 34 along the leading edge portion 36 of the vanes proximate the mating diffuser wall when the diffuser 30 is assembled.

Figure 5:
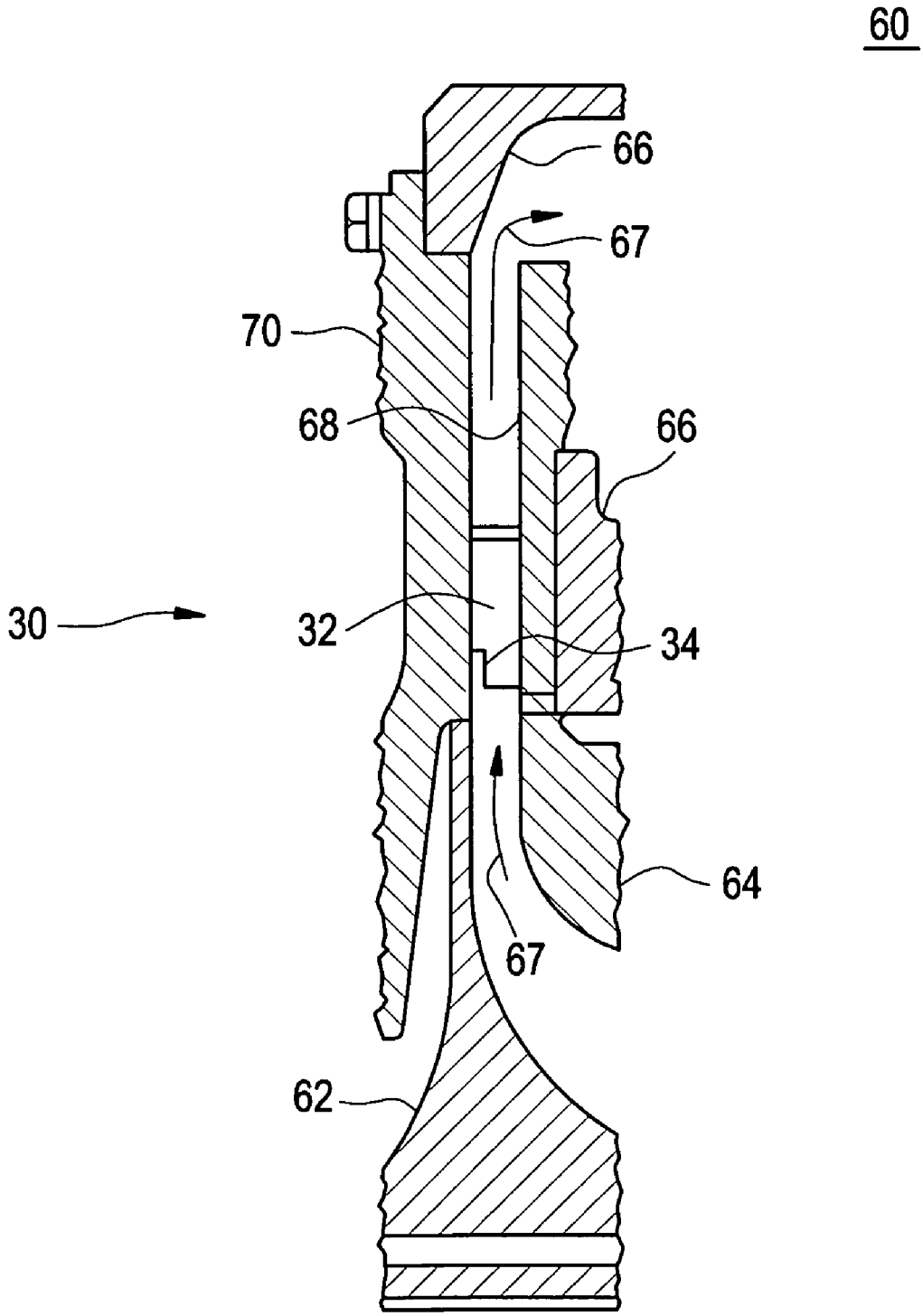
FIG. 5 is a partial cross-sectional view of a compressor having slotted diffuser vanes.

FIG. 5 is a partial cross-sectional view of a compressor 60 including the improved diffuser 30 of FIG. 2. Impeller 62 is rotatable between an air inlet housing 64 and a compressor casing 70 to provide a flow of compressed working fluid 67 through diffuser 30 and into the blower casing 66. The diffuser vane 32 is situated between opposed diffuser walls; in this embodiment one wall being the diffuser base plate 68 and the other opposed wall being the compressor casing 70. Flow slot 34 is formed in the leading edge of the diffuser vane 32 adjacent the casing 70.

Figure 6:
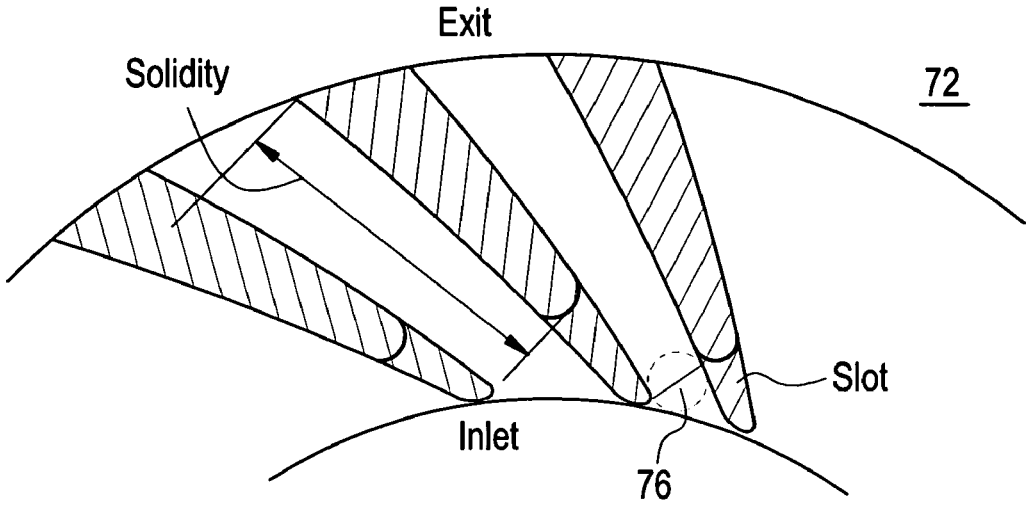
FIG. 6 illustrates the throat region of a slotted vane island diffuser.
Figure 7:
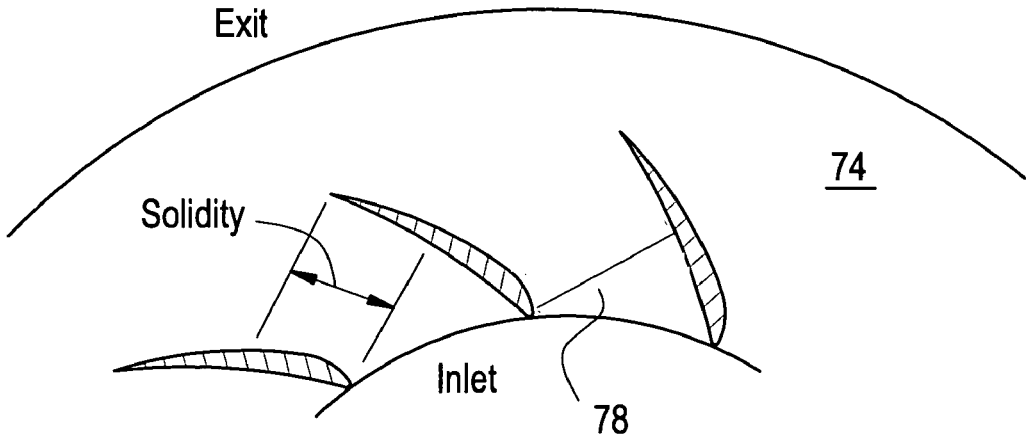
FIG. 7 illustrates the throat region of a slotted vane cascade diffuser.

FIG. 6 is a partial top sectional view of an improved vane island diffuser (wedge diffuser) 72. FIG. 7 is a partial top sectional view of an improved cascade diffuser 74. The throat 76, 78 of these respective diffusers 72, 74 is the distance between adjacent vanes at their closest points along their respective chord lengths. The flow openings of the present invention may extend from the vane leading edge or from a point downstream of the leading edge along a suitable distance along the chord length of the vane, for example in the range of from at least 5% to no more than 25% or no more than 38% of the chord length of the vane in various embodiments. A flow slot may extend along only a leading edge portion of the vane upstream from a throat of the vane and not from the throat to points downstream of the throat, as illustrated in FIG. 6.

The depth of the slots may be of a suitable dimension, such as no more than 10% of the height of the vane perpendicular to the vane chord in one embodiment, or no more than 5% of that height in another embodiment. Because the opening defines a fluid flow path, there may be a practical minimum established in order to avoid plugging due to debris carried by the working fluid, for example no less than 50 mils.

Figure 8:
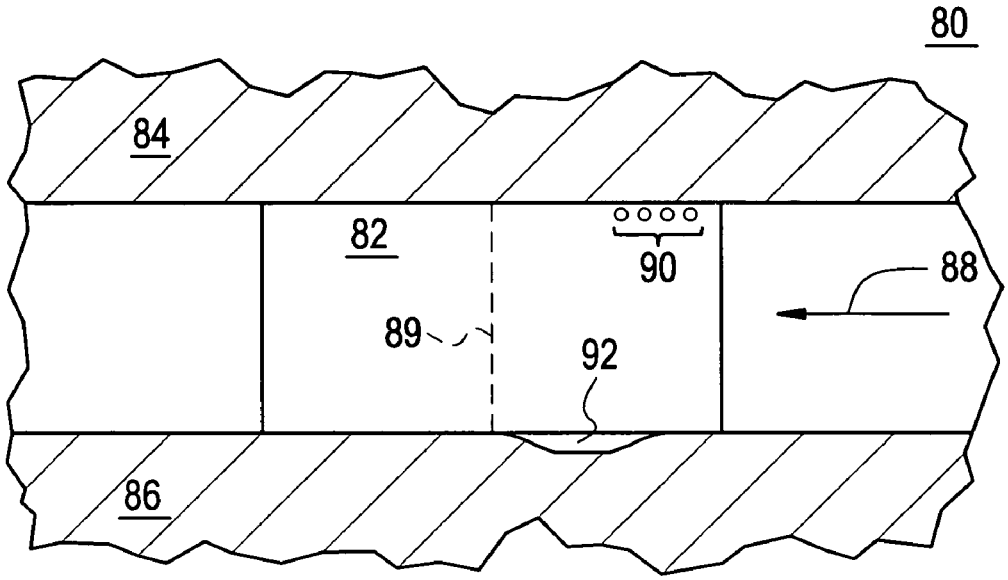
FIG. 8 is a partial cross-sectional view of a compressor diffuser having a plurality of flow passages from the pressure side to the suction side of a vane.

The precise location and geometry of the flow opening from the pressure side to the suction side of a diffuser airfoil may vary for different applications. The flow path may be a single opening or a plurality of openings spaced apart along the chord of the vane. Each of such multiple openings may have the same or different geometries. It is believed that the flow slots are best formed at the juncture of the vane and one of the respective opposed walls, since it is along this corner that flow separation generally first develops. However, the opening may be formed in the vane somewhat removed from the adjoining wall in certain embodiments or it may be formed in the mating wall member, as illustrated in FIG. 8. FIG. 8 is a partial cross-sectional view of view of a compressor diffuser 80 having a vane 82 connected between opposed walls 84, 86 for directing a flow of a working fluid 88. At least one hole 90 is drilled through the vane 82 to have an inlet on the pressure side and an outlet on the suction side proximate a first of the walls 84 to allow a first portion of the working fluid 88 to flow there through. The outlet of the hole 90 is located on the suction side of the vane 82 upstream from a throat location 89 (illustrated by dashed line). A second portion of the working fluid 88 may be permitted to flow from the pressure side to the suction side through an opening formed as a groove 92 in the second of the walls 86. The location of the holes 90 and groove 92 along the chord of the vane 82 may be selected to optimize the impact of the respective bypass flows on the formation of a downstream flow separation zone. From a manufacturing perspective, it may be convenient to form a flow opening as a machined notch between the pressure and suction side surfaces along a top surface of a vane, and/or as a machined groove into a diffuser wall, prior to the wall being mated to the vane. In certain embodiments it may be desired to form a flow slot on both opposed sides of the vane proximate both opposed diffuser walls.

In general, it may be desired to create the minimum amount of bypass flow over the vane that is necessary to suppress expansion of the flow separation zone on the suction side of the vane to the extent necessary to achieve a desired degree of improvement in the exit flow distribution and in the low and high flow performance of the diffuser. Generally, more bypass flow will result in a greater improvement in low and high flow performance with a corresponding decrease in peak efficiency of the compressor, thus suggesting a cost/benefit analysis for arriving at optimal bypass flow opening geometry for a particular application. For a turbo-charger compressor such as used in modern locomotives manufactured by the assignee of the present invention, a typical diffuser vane may have a chord length of about 4 inches and a vane height of about 0.9 inch. Flow slots having widths of 0.050 inches and 0.085 inches and extending along about 15% of the chord length have been tested with success in such units.

Figure 9:
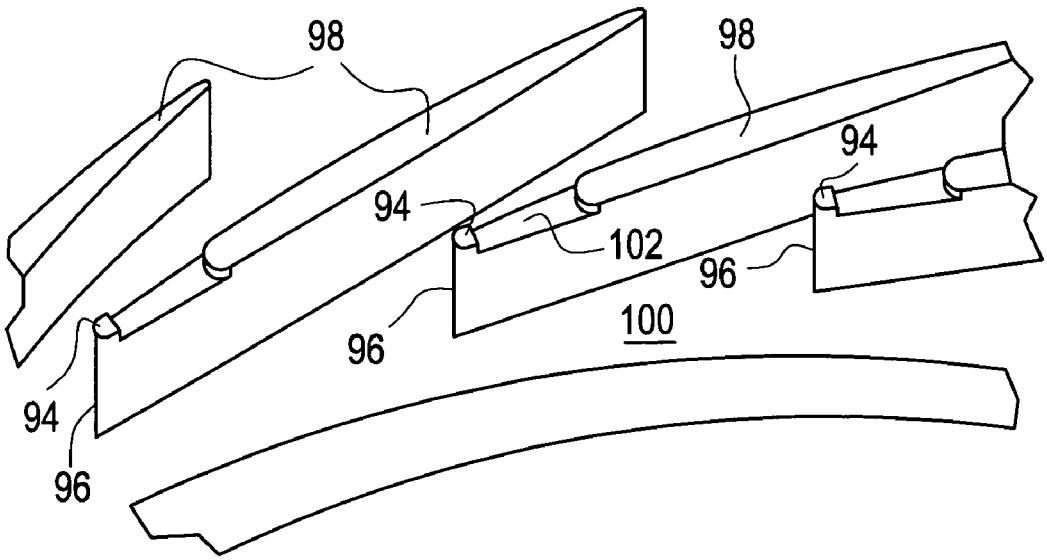
FIG. 9 is a perspective view of a portion of a diffuser having slotted vanes with leading edge support members.

FIG. 9 is a partial perspective illustration of a further embodiment wherein a support connection 94 is used between the leading edge 96 of the vane 98 and the diffuser wall 100 in order to provide mechanical support for the leading edge 96 of the vane 98, if necessary or desired. The flow opening 102 extends along the leading edge portion of the vane 98 downstream from the support connection 94. The support connection 94 may be an integral extension of the vane material or it may be fabricated such as by welding or it may be a separately attached piece of material. In one embodiment, the flow opening 102 may begin about 0.1 inches back from the leading edge 96 for a vane 98 such as described above for a locomotive turbo-charger compressor. The leading edge support may be applied to address diffuser vane vibration, particularly on thin-vaned diffusers. Such vibration may be excited by compressor wheel blade and diffuser vane flow interaction. The support 94 creates a mechanical constraint for the leading edge 96 of the vane 98, and therefore, it prevents excessive vibration that may be detrimental to the life of the component.

While various embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim:

1. A diffuser for a compressor, the diffuser comprising:

opposed walls defining a space disposed downstream of a compressor impeller for receiving a flow of a working fluid from the impeller;

a vane comprising a pressure side and a suction side connected between the opposed walls for directing the working fluid through the space; and a flow slot formed between the vane and one of the walls, the flow slot extending along a portion of the vane upstream from a throat of the vane for allowing a portion of the flow of working fluid to pass from the pressure side to the suction side of the vane to suppress expansion of a flow separation zone on the suction side of the vane;

wherein the flow slot comprises a groove formed into a surface of the vane prior to that surface being connected to a respective adjacent one of the walls.

2. The diffuser of claim 1, wherein the flow slot extends to a leading edge of the vane.

3. The diffuser of claim 1, wherein the slot is formed to extend downstream from a point downstream of a leading edge of the vane to define a support connection between the vane and the one of the walls at the leading edge.

4. The diffuser of claim 1, wherein the flow slot comprises a height perpendicular to a chord of the vane of no more than 5% of a total height of the vane perpendicular to the chord of the vane.

5. The diffuser of claim 1, wherein the flow slot comprises a height perpendicular to a chord of the vane of no more than 10% of a total height of the vane perpendicular to the chord of the vane.

6. The diffuser of claim 1, wherein the flow slot extends along no more than 25% of a chord length of the vane.

7. The diffuser of claim 1, wherein the flow slot extends along no more than 38% of a chord length of the vane.

8. The diffuser of claim 1, wherein the flow slot extends along at least 5% of a chord length of the vane.

9. A compressor comprising the diffuser of claim 1.

10. A diffuser for a compressor, the diffuser comprising:

opposed walls defining a space disposed downstream of a compressor impeller for receiving a flow of a working fluid from the impeller;

a vane comprising a pressure side and a suction side connected between the opposed walls for directing the working fluid through the space; and a flow opening having an inlet on the pressure side of the vane and an outlet on the suction side of the vane upstream from a throat location on the vane for allowing a portion of the flow of working fluid to pass from the pressure side to the suction side of the vane;

wherein the flow opening comprises a hole drilled between the pressure side and the suction side of the vane.

11. The diffuser of claim 10, wherein the flow opening is formed in one of the opposed walls.

12. The diffuser of claim 10, wherein a height of the flow opening perpendicular to a chord of the vane is no more than 5% of a total height of the vane.

13. The diffuser of claim 10, wherein a height of the flow opening perpendicular to a chord of the vane is no more than 10% of a total height of the vane.

14. The diffuser of claim 10, wherein the flow opening is formed proximate an intersection of the vane and one of the opposed walls.

15. The diffuser of claim 10, wherein the flow opening comprises a flow slot formed between the vane and one of the opposed walls.

16. The diffuser of claim 10, wherein the flow opening extends downstream from a point downstream of a leading edge of the vane to define a support connection between the vane and the opposed walls at the leading edge.

17. A compressor comprising the diffuser of claim 10.

18. A diffuser for a compressor, the diffuser comprising:

opposed walls defining a space disposed downstream of a compressor impeller for receiving a flow of a working fluid from the impeller;

a vane comprising a pressure side and a suction side connected between the opposed walls for directing the working fluid through the space; and a flow opening having an inlet on the pressure side of the vane and an outlet on the suction side of the vane upstream from a throat location on the vane for allowing a portion of the flow of working fluid to pass from the pressure side to the suction side of the vane;

wherein the flow opening comprises a first flow opening formed proximate a first of the opposed walls allowing a first portion of the flow of working fluid to pass from the pressure side to the suction side of the vane, and further comprising a second flow opening formed proximate a second of the opposed walls allowing a second portion of the flow of working fluid to pass from the pressure side to the suction side of the vane.

* * * * *